US005103729A

United States Patent [19]

Philpot

[11] Patent Number: 5,103,729

[45] **Date of Patent: * Apr. 14, 1992**

[54] APPARATUS FOR SECURING A PRINTING PLATE TO A PRINTING PLATE CYLINDER AND A PRINTING PLATE COMPOSITE UTILIZING SUCH APPARATUS

[75] Inventor: Ivan N. Philpot, Irving, Tex.

[73] Assignee: Matthews International Inc., Pittsburgh, Pa.

[ * ] Notice: The portion of the term of this patent subsequent to Feb. 11, 2009 has been disclaimed.

[21] Appl. No.: 586,273

[22] Filed: Sep. 21, 1990

[51] Int. Cl.[5] ..... B41F 27/00

[52] U.S. Cl. ..... 101/415.1; 101/378; 101/383

[58] Field of Search ..... 101/378, 382.1, 383, 101/384, 385, 386, 387, 388, 389, 415.1, DIG. 36, 376, 485, 486

[56] References Cited

U.S. PATENT DOCUMENTS

| | | | |
|---|---|---|---|
| 3,213,790 | 10/1965 | McKay | 101/376 |
| 3,228,329 | 1/1966 | Mangus et al. | 101/378 |
| 3,295,443 | 1/1967 | Devon | 101/376 |
| 3,489,085 | 1/1970 | Kirkpatrick | 101/415.1 |
| 3,675,573 | 7/1972 | Hawks | 101/378 |
| 3,745,921 | 7/1973 | MacDonald et al. | 101/378 |
| 3,934,509 | 1/1976 | Saunders et al. | 101/415.1 |
| 4,047,481 | 9/1977 | Saunders | 101/376 |
| 4,932,324 | 6/1990 | Pinkston et al. | 101/415.1 |

OTHER PUBLICATIONS

Rogers Corporation News Release.

*Primary Examiner*—Edgar S. Burr
*Assistant Examiner*—Ren Yan
*Attorney, Agent, or Firm*—James Ray & Associates

[57] ABSTRACT

An improved compressible-type printing plate composite for use in a printing arrangement and a printing plate composite securing device is provided by this invention. Such composite includes specially designed members having each of a carrier sheet and a printing plate carrier sheet secured thereto. Disposed intermediate such carrier sheet and such printing plate carrier sheet is a sponge-like member which provides the requisite amount of compressibility to such composite. This sponge-like member is secured to one surface of the carrier sheet.

41 Claims, 2 Drawing Sheets

APPARATUS FOR SECURING A PRINTING PLATE TO A PRINTING PLATE CYLINDER AND A PRINTING PLATE COMPOSITE UTILIZING SUCH APPARATUS

FIELD OF THE INVENTION

The present invention relates, in general, to printing of substrate materials which are used in the packaging industry and, more particularly, the invention relates to both an apparatus useful in securing at least one printing plate to a printing plate cylinder located in at least one print station disposed in a printing arrangement for such package substrate material and to a printing plate composite utilizing such securing apparatus.

BACKGROUND OF THE INVENTION

Prior to the development of the present invention, in the retail sales industry it has become the normally accepted practice to utilize what is now commonly known in the packaging industry as "point-of-sale" packaging for the vast majority of packaged products being offered for sale in the various retail outlets This particular practice, as would generally be expected, has been instrumental in forcing the packaging industry to not only develop but also to implement both new equipment and operating practices which are capable of providing significant improvements in the overall quality of printing on the substrate material being used as the product packages In other words, the old style "brown box" is no longer acceptable in the packaging of products which are offered for sale in these retail sales outlets. Primarily as a result of this more demanding practice, flexographic printing equipment is generally in widespread use throughout such package printing industry. See, for example, the December, 1979, issue of Boxboard Containers, in which there was published an article entitled, "It's Time For A Change In Flexo". Flexographic printing technology, as pointed out in this article, was introduced for use in this area in the 1960's. It was then that convertors started to install the equipment which was necessary for them to initiate the use of the flexographic printing process. As soon as the equipment was installed, it became possible for the convertor to now print, slot, fold, glue, die-cut and bundle in a true production line-type operation with his new flexographic printing equipment.

In addition to all of the inherent advantages the convertor gained by such production line-type operation, this change in equipment to enable implementation of the flexographic printing process presented the convertor with the potential for expanded capabilities as well as other improvements in package printing at the same time. For some reason, however, these additional potential benefits were generally not immediately taken advantage of by the packaging convertor. This is evidenced by the fact that even with this new process and equipment, the majority of such convertors continued the practice of using the same old, outmoded printing plate systems which were being used prior to the introduction of the modern flexographic printing system in such packaging industry. The old printing plate system generally consisted of a relatively thick rubber plate which was secured to a fabric-like material In turn, this fabric-like material was then secured to a carrier material In fact, it was not until the late 1970's and early 1980's that any significant change occurred in the printing plate system being used in this flexographic printing process. The use of a cellular polyurethane material as a backing material for flexible type printing plates was first introduced by the Rogers Corporation at that time. These flexible type printing plates are secured directly to one surface of such cellular polyurethane material in this system. In turn, such cellular polyurethane material is glued to the printing plate cylinder This glueing of such cellular polyurethane material to the printing plate cylinder is accomplished with either an adhesive film or with what is commonly known in the printing industry as "sticky back" tape Additionally, in some cases, such cellular polyurethane material is adhered to and supported on a polyester backing material, such as, mylar. In this case, such polyester backing material is then adhered to an outer working surface of such printing plate cylinder. Regardless, with or without such polyester backing material, the flexible printing plate is positioned on and adhered to the upper surface of such cellular polyurethane material in the Rogers Corporation system.

In view of the fact that this particular printing plate system is essentially adhered directly to the working surface of the printing plate cylinder with an adhesive material, it stands to reason that added care must be exercised in aligning and mounting such printing plate to the cellular polyurethane material as well as the printing plate system thereafter to such working surface of the printing plate-cylinder so that proper alignment can be ensured This is particularly the case, for example, when a plurality of colors are required to be printed on the substrate material forming a product package. The time consumed to ensure, proper alignment of this printing plate system is costly to the convertor not only from the manpower expense but also from the loss in production time for the equipment. Obviously this added cost must be passed on to the consumer.

At the present time, it is also known in the prior art to use a substantially T-shaped member to both align and secure in place one end of a vinyl sheet having a printing plate mounted thereon to a bar-like member that is positioned on such working surface of the printing plate cylinder. Such bar-like member is disposed substantially parallel to the longitudinal axis of the printing plate cylinder. In this prior art arrangement, the back surface of the vinyl sheet is engaged directly with the working surface of such printing plate cylinder. In order to use this system, the T-shaped member is engaged with one end of the vinyl sheet and with the bar-like member disposed on such printing plate cylinder. The axially opposed other end of the vinyl sheet is normally secured to such working surface of the printing plate cylinder with either tape or with strap-like members This particular printing plate fastening system is known in the package printing industry as the Matthews Fast-Loc System and is in widespread use in such packaging printing industry. Use of such Matthews Fast-Loc System results in significantly reduced downtime being required on the printing equipment in order to achieve the necessary alignment of the printing plate on the working surface of such printing plate cylinder. This, therefore, enables an increase in the productivity of such printing arrangement to be achieved.

Even though each of the above-identified important technical advances in printing plates systems have generally enhanced the printing quality achieved on package-type substrate materials commonly used in the packaging industry, they, nevertheless, each have certain critical limitations associated with their use in this particular application. For example, even though the Rogers printing plate system does enable a generally poorer quality substrate material to be used as a package and is not as sensitive to other slight imperfections which may be present on the working surface of the printing plate cylinder, this printing plate system still requires a considerable amount of time be expended to set up in the printing arrangement so that the necessary alignment of the printing plate on the working surface of the printing plate cylinder is achieved. The Matthews' Fast-Loc printing plate system, on the other hand, can normally be set up rather quickly in the printing arrangement, however, this particular Fast-Loc System does require a somewhat higher quality substrate material to be used and will additionally be generally somewhat more sensitive to such imperfections which can be present on the working surface of such printing plate cylinders.

Another significant drawback common to both the Rogers, printing plate system and the Matthews' Fast-Loc system is that because the printing plate is mounted directly on the surface of the cellular polyurethane material and the vinyl sheet, respectively, the entire system must be removed in order to change printing plates.

SUMMARY OF THE INVENTION

According to a first aspect of the present invention, there is provided an apparatus for securing a printing plate to a printing plate cylinder disposed in at least one print station of a printing arrangement. This printing plate securing apparatus includes a first elongated J-shaped hook-like member. Such first hook-like member has a first elongated substantially flat strip-like portion having each of first and second axially opposed edges and first and second axially opposed surfaces. One of the first and second axially opposed surfaces is both engageable with and secured to one edge portion of one of an upper and a bottom surface of a carrier sheet having a sponge-like member disposed on the upper surface thereof. Such first flat strip-like portion of the J-shaped first hook-like member having a first predetermined length and a first predetermined width and a first predetermined thickness. The J-shaped first hook-like member also has a second elongated substantially flat strip-like portion having each of first and second axially opposed edges and first and second axially opposed surfaces. Such second flat strip-like portion is engageable at the first edge thereof with at least a portion of a bar-like member disposed substantially parallel to a longitudinal axis of the printing plate cylinder and adjacent the working surface thereof. The second flat strip-like portion has a second predetermined length and a second predetermined width and a second predetermined thickness. The final element of the first J-shaped hook-like member is a first elongated connecting strip-like portion having each of first and second axially opposed edges and first and second axially opposed surfaces. The first edge of the first connecting strip-like portion is engaged with and secured to the first edge of the first flat-strip-like portion and the second edge of the first connecting strip-like portion is engaged with and secured to the second edge of such second flat-strip-like portion thereby forming such first J-shaped hook-like member. This first connecting strip-like portion having a third predetermined length and third predetermined width and third predetermined thickness. The apparatus also includes a second elongated J-shaped hook-like member. Such second hook-like member including a third elongated substantially flat strip-like portion having each of first and second axially opposed edges and first and second axially opposed surfaces. A first of such first and second axially opposed surfaces of the third flat strip-like portion is engageable with and securable to one of such one edge portion of the upper surface of such carrier sheet and a second of such first and second axially opposed surfaces of such first flat strip-like portion. This third flat strip-like portion having a fourth predetermined length and a fourth predetermined width and a fourth predetermined thickness. This second hook-like member also has a fourth elongated substantially flat strip-like portion having each of first and second axially opposed edges and first and second axially opposed surfaces. Such fourth flat strip-like portion having a fifth predetermined length and a fifth predetermined width and fifth predetermined thickness. A second elongated connecting strip-like portion having each of first and second axially opposed edges and first and second axially opposed surfaces forms the final essential element of the second hook-like member. The first edge of this second connecting strip-like portion is engaged with and secured to the first edge of such third flat strip-like portion and the second edge of such second connecting strip-like portion is engaged with and secured to the first edge of such fourth flat strip-like portion thereby forming such second J-shaped hook-like member. The second connecting strip-like portion having a sixth predetermined length and a sixth predetermined width and a sixth predetermined thickness. The apparatus further includes a third elongated J-shaped hook-like member. Such third hook-like member including a fifth elongated substantially flat strip-like portion having each of first and second axially opposed edges and first and second axially opposed surfaces One of such first and second axially opposed surfaces is engageable with and securable to one edge portion of one of an upper surface and a bottom surface of a second carrier sheet. Such carrier sheet has at least one printing plate disposed on such upper surface thereof. This fifth flat strip-like portion has a seventh predetermined length and a seventh predetermined width and a seventh predetermined thickness. Such third hook-like member also includes a sixth elongated substantially flat strip-like portion having each of first and second axially opposed edges and first and second axially opposed surfaces. The first edge of this sixth flat strip-like portion is positionable adjacent the first surface of the second connecting strip-like portion during use of such apparatus. The sixth flat strip-like portion has an eighth predetermined length and an eighth predetermined width and an eighth predetermined thickness. The final essential component of the third hook-like member is a third connecting strip-like portion having each of first and second axially opposed edges and first and second axially opposed surfaces. Such first edge of the third connecting strip-like portion is engaged with and secured to the first edge of such fifth flat strip-like portion and the second edge of such third connecting strip-like portion is engaged with and secured to the second edge of such sixth flat strip-like portion. The second edge of the fourth flat strip-like portion is positionable adjacent the first surface of such third connecting strip-like portion during such use of such apparatus. Such third connecting strip-like portion having a ninth predetermined length and a ninth predetermined width and a ninth predetermined thickness.

According to a second aspect of the present invention, there is provided an alternative apparatus useful in forming a printing plate composite. This alternative apparatus enables such printing plate composite formed therewith to be quickly secured both in place and in an accurately aligned position on at least a predetermined portion of a working surface of a printing plate cylinder positioned in at least one print station disposed in a printing arrangement. This apparatus comprises an elongated substantially S-shaped double hook-like member. Such double hook-like member including a first elongated substantially flat strip-like portion having each of first and second axially opposed edges and first and second axially opposed surfaces. The first surface is engageable with and securable to one edge portion of an upper surface of a first carrier sheet having a sponge-like member disposed on such upper surface thereof. Such first flat strip-like portion having a first predetermined length and a first predetermined width and first predetermined thickness. A second elongated substantially flat strip-like portion having each of first and second axially opposed edges and first and second axially opposed surfaces is provided. The first edge of such second flat strip is engageable with at least a portion of a bar-like member disposed parallel to a longitudinal axis of such printing plate cylinder and adjacent such working surface thereof. Such second flat strip-like portion having a second predetermined length and a second predetermined width and a second predetermined thickness. A third elongated substantially flat strip-like portion having each of first and second axially opposed edges and first and second axially opposed surfaces is also part of such double hook-like member. Such third flat strip-like portion having a third predetermined length and a third predetermined width and a third predetermined thickness. A first elongated connecting strip-like portion having each of first and second axially opposed edges and first and second axially opposed surfaces is provided. The first edge of such first connecting strip-like portion is engaged with and secured to the first edge of such first flat strip-like portion and the second edge of such first connecting strip-like portion is engaged with and connected to the second edge of such second flat strip-like portion. This first connecting strip-like portion has a fourth predetermined length and a fourth predetermined width and a fourth predetermined thickness.

A second elongated connecting strip-like portion having each of first and second axially opposed edges and first and second axially opposed surfaces is also required to form the double hook-like member. The first edge of such second connecting strip-like portion is engaged with and connected to the second edge of such first flat strip-like portion and the second edge of such second connecting strip-like portion is engaged with and connected to the first edge of such third flat strip-like portion. Such second connecting strip-like portion having a fifth predetermined length and a fifth predetermined width and a fifth predetermined thickness. The apparatus further includes an elongated substantially J-shaped hook-like member. Such J-shaped hook-like member including a fourth elongated substantially flat strip-like portion having each of first and second axially opposed edges and first and second axially opposed surfaces. One of the first and the second surfaces is engageable with and securable to one edge portion of one of a respective upper surface and a bottom surface of a second carrier sheet. There is at least one printing plate mounted on such upper surface of such second carrier sheet. Such fourth flat strip-like portion having a sixth predetermined length and a sixth predetermined width and a sixth predetermined thickness. A fifth elongated substantially flat strip-like portion having each of first and second axially opposed edges and first and second axially opposed surfaces forms a part of the J-shaped hook-like member. The first edge of such fifth flat strip-like portion is positionable adjacent the first surface of such second connecting strip-like portion during use of such apparatus. Such fifth flat strip-like portion having a seventh predetermined length and a seventh predetermined width and a seventh predetermined thickness. The final essential component of such J-shaped hook-like member is a third elongated connecting strip-like portion having each of first and second axially opposed edges and first and second axially opposed surfaces. The first edge of such third connecting strip-like portion is engaged with and secured to the first edge of such fourth flat strip-like portion and the second edge of such third connecting strip-like portion is engaged with and connected to the second edge of such fifth flat strip-like portion. Such second edge of such third flat strip-like portion is positionable adjacent the first surface of such third connecting strip-like portion during such use of the apparatus. This third connecting strip-like portion having an eighth predetermined length and an eighth predetermined width and an eighth predetermined thickness.

According to a third aspect of the present invention, there is provided another alternative apparatus useful in forming a printing plate composite. This apparatus enables such printing plate composite formed therewith to be quickly secured both in place and in an accurately aligned position on at least a predetermined portion of a working surface of a printing plate cylinder positioned in at least one print station disposed in a printing arrangement. This apparatus includes an elongated hook-like member. Such hook-like member having a first elongated substantially flat strip-like member having each of first and second axially opposed edges and first and second axially opposed surfaces. One of the first and at least a first portion of the second surfaces is engageable with and securable to one edge portion of a bottom surface and an upper surface, respectively, of a first carrier sheet having a sponge-like material disposed on such upper surface thereof. Such first flat strip-like portion having a first predetermined length and first predetermined width and a first predetermined thickness. Also required is a second elongated substantially flat strip-like portion having each of first and second axially opposed edges and first and second axially opposed surfaces. The first edge of such second flat strip-like portion being engageable with a bar-like member disposed substantially parallel to a longitudinal axis of such printing plate cylinder and adjacent such working surface thereof. Such second flat strip-like portion having a second predetermined length and a second predetermined width and a second predetermined thickness. Such hook-like member further having a first connecting strip-like portion having each of first and second axially opposed edges and first and second axially opposed surfaces. The first edge of such first connecting strip-like portion is engaged with and connected to the second surface of such first flat strip-like portion intermediate the first and second axially opposed edges. The second edge of such first connecting strip-like portion is engageable with and connected to the second edge of such second flat strip-like portion. Such first connecting strip-like portion having a third predetermined length and a third predetermined width and a third predetermined thickness. Such apparatus further includes an elongated substantially J-shaped hook-like member. Such J-shaped hook-like member including a third elongated substantially flat strip-like portion having each of first and second axially opposed edges and first and second axially opposed surfaces. One of the first and the second axially opposed surfaces being engageable with and securable to one edge portion of one of an upper surface and a bottom surface, respectively, of a second carrier sheet having at least one printing plate mounted thereon. Such third flat strip-like portion having a fourth predetermined length and a fourth predetermined width and a fourth predetermined thickness. Such hook-like member further having a fourth elongated substantially flat strip-like portion having each of first and second axially opposed edges and first and second axially opposed surfaces. The first edge of such fourth flat strip-like portion being positionable adjacent the second surface of such first connecting strip-like portion during use of such apparatus. Such fourth flat strip-like portion having a fifth predetermined length and fifth predetermined width and a fifth predetermined thickness. The final essential component of this hook-like member is a second elongated connecting strip-like portion having each of first and second axially opposed edges and first and second axially opposed surfaces. Such first edge of such second connecting strip-like portion is engaged with and connected to the first edge of such third flat strip-like portion and the second edge of such second connecting strip-like portion is engaged with and connected to the second edge of such fourth flat strip-like portion. The first edge of such first flat strip-like portion being positioned adjacent the first surface of such second connecting strip-like portion during such use of the apparatus. This second connecting strip-like portion having a sixth predetermined length and a sixth predetermined width and a sixth predetermined thickness.

According to a fourth aspect of the invention, there is provided an improved compressible-type printing plate composite which includes both a quick mounting and a quick alignment system incorporated therein that will enable such printing plate composite to be quickly secured in place on at least a predetermined portion of a working surface of a printing plate cylinder positioned in at least one print station disposed in a printing arrangement, in an accurately aligned position, this compressible-type printing plate composite including an elongated substantially J-shaped hook-like member. Such hook-like member including a first elongated substantially flat strip-like portion having each of first and second axially opposed edges and first and second axially opposed surfaces. Such first flat strip-like portion having a first predetermined length and a first predetermined width and a first predetermined thickness. Also such hook-like member has a second elongated substantially flat strip-like portion having each of first and second axially opposed edges and first and second axially opposed surfaces. The first edge of such second flat strip-like portion being engageable with a bar-like member disposed substantially parallel to a longitudinal axis of such print plate cylinder and adjacent such working surface thereof. Such second flat strip-like portion having a second predetermined length and a second predetermined width and a second predetermined thickness. The final component of the hook-like member is an elongated strip-like portion having each of first and second edges and first and second surfaces. The first edge of such connecting strip-like portion is engaged with and secured to the first edge of such first flat strip-like portion and the second edge of such connecting strip-like portion is connected to the second edge of such second flat strip-like portion thereby forming such J-shaped hook-like member. Such connecting strip-like portion having a third predetermined length and a third predetermined width and a third predetermined thickness. A first carrier sheet member having a fourth predetermined length and a fourth predetermined width and a fourth predetermined thickness is provided. Such first carrier sheet is engageable adjacent one edge of one of an upper surface and a bottom surface, respectively, with one of such first and such second surfaces of such first flat strip-like portion. This printing plate composite includes a sponge-like member secured to the upper surface of such first carrier sheet. Such sponge-like material having a fifth predetermined length and a fifth predetermined width and a fifth predetermined thickness. A second carrier sheet having a sixth predetermined length and a sixth predetermined width and a sixth predetermined thickness is provided. Such second carrier sheet is engageable adjacent one edge of a bottom surface thereof with one of such one edge of such upper surface of such first carrier sheet and such second surface of such first flat strip-like portion. There is at least one printing plate member secured to an upper surface of such second carrier sheet. Finally, this printing plate composite has a securing means engageable with each of such one edge of such first carrier sheet and such one edge of such second carrier sheet and such first flat strip-like portion for securing the first and the second carrier sheet to such first flat strip-like portion.

OBJECTS OF THE INVENTION

It is, therefore, one of the primary objects of the present invention to provide an apparatus for securing a printing plate to a printing plate cylinder disposed in a printing arrangement which will enable quick and accurate alignment of the printing plate on such printing plate cylinder.

Another object of the present invention is to provide a printing plate composite having a means for securing a printing plate to a printing plate cylinder disposed in a printing arrangement quickly and in an accurately aligned position.

Still another object of the present invention is to provide an apparatus for securing a printing plate to a printing plate cylinder disposed in a printing arrangement which is easy to use.

Yet another object of the present invention is to provide a printing plate composite which will provide improved print quality even when substandard substrate material is being used to receive the printed matter thereon.

A further object of the present invention is to provide an apparatus for securing a printing plate to a printing plate cylinder in a printing arrangement which is relatively inexpensive to manufacture.

An additional object of the present invention is to provide a printing plate composite which is insensitive to minor imperfections present on the working surface of a printing plate cylinder to which such printing plate composite is to be secured.

Another object of the present invention is to provide an apparatus for securing a printing plate to a printing plate cylinder in a printing arrangement which can be produced in a number of different shapes.

Still yet another object of the present invention is to provide a printing plate composite which can be readily produced in the required thicknesses.

Yet still another object of the present invention is to provide an apparatus for securing a printing plate to a printing plate cylinder which can be easily molded into the desired shape.

A still further object of the present invention is to provide a printing plate composite which will substantially minimize board crush encountered during a printing operation.

It an additional object of the present invention to provide an apparatus for securing a printing plate to a printing plate cylinder in a printing arrangement which requires a minimum amount of maintenance.

Another object of the present invention is to provide a printing plate composite which enables printing over low spots which may be present in the substrate material.

Still another object of the present invention is to provide a printing plate composite which greatly simplifies making of the printing plates to be used.

Yet another object of the present invention is to provide a printing plate composite which will significantly extend the useful life of the printing plate.

A still further object of the present invention is to provide a printing plate composite which will result in fewer rejections of the finished product.

An additional object of the present invention is to provide a printing plate composite which can be used with either a rubber or photopolymer type printing plate.

Yet another object of the present invention is to provide a printing plate composite which can tolerate a wide range of impression squeeze.

Still another object of the present invention is to provide an apparatus for securing a printing plate to a printing plate cylinder in a printing arrangement and a printing plate composite utilizing such apparatus which will result in significantly less downtime of such printing arrangement due to adjustments being required.

A still further object of the present invention is to provide an apparatus for securing a printing plate to a printing plate cylinder in a printing arrangement and a printing plate composite utilizing such apparatus which will enable such printing arrangement to be operated at a faster line speed without an adverse effect on the print quality being achieved.

It is an additional object of the present invention to provide an apparatus for securing a printing plate to a printing plate cylinder in a printing arrangement and a printing plate composite utilizing such apparatus which are highly cost effective.

Still a further object of the present invention is to provide an apparatus to secure a printing plate to a printing plate cylinder disposed in a printing arrangement and a printing plate composite utilizing such apparatus which does not require removal of the entire composite when the printing plate being used must be changed a order to start a new job.

In addition to the numerous objects and advantages of the apparatus for securing a printing plate to a printing plate cylinder disposed in a printing arrangement and the printing plate composite utilizing such apparatus which have been discussed above, various other objects and advantages of the present invention will become more readily apparent to those persons who are skilled in the printing art from the following more detailed description of such invention, particularly, when such description is taken in conjunction with the attached drawings and the appended claims.

BRIEF DESCRIPTION OF THE INVENTION

Figure 1:
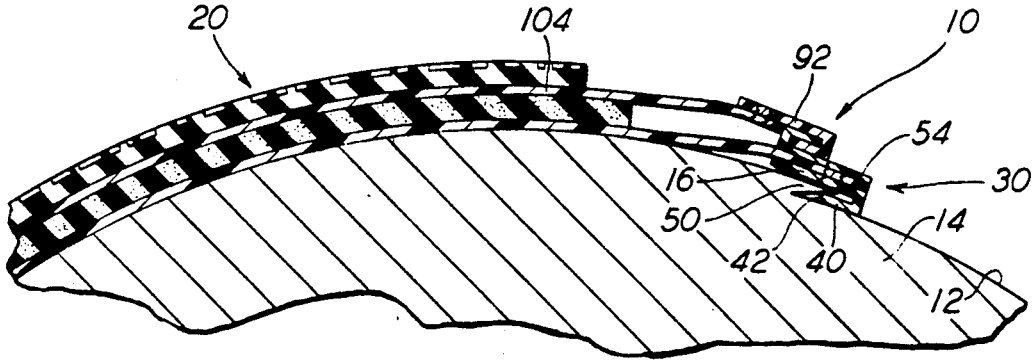
FIG. 1 is a fragmented side elevation view, in cross-section, which illustrates one presently preferred embodiment of the invention engaged on a working surface of a printing plate cylinder.
Figure 2:
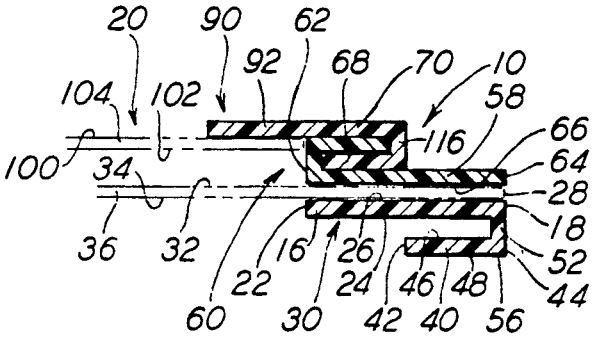
FIG. 2 is an enlarged fragmented side elevation view, in cross-section, which illustrates the printing plate composite securing apparatus shown in FIG. 1.

Before proceeding to the more detailed description of the apparatus for securing a printing plate to a printing plate cylinder and a printing plate composite utilizing such apparatus, it should be noted that in each of the several views illustrated in the drawings, identical components which have identical functions have been identified, for the sake of clarity, with identical reference numerals.

Now refer more particularly to FIGS. and 2, wherein there is illustrated an apparatus, generally designated 10, useful in forming a printing plate composite, generally designated 20. The apparatus 10 enables such printing plate composite 20 formed therewith to be quickly secured both in place and in an accurately aligned position on at least a predetermined portion of a working surface 12 of a printing plate cylinder 14 positioned in at least one point station (not shown) disposed in a printing arrangement (not shown).

The apparatus 10 comprises a first elongated J-shaped hook-like member, generally designated 30. Such first hook-like member 30 includes a first elongated substantially flat strip-like portion 16 having each of first and second axially opposed edges, designated 18 and 22, respectively, and first and second axially opposed surfaces, designated 24 and 26, respectively. One of such first and second axially opposed surfaces 24 and 26 is engageable with and securable to one edge portion 28 of one of an upper surface and a bottom surface, designated 32 and 34, respectively, of a first carrier sheet 36. A sponge-like member 38 is disposed on such upper surface 32 of the carrier sheet 38 Such first flat strip-like portion 16 has a first predetermined length and first predetermined width and first predetermined thickness. A second elongated substantially flat strip-like portion 40 is provided and has each of first and second axially opposed edges, designated 42 and 44, respectively, and first and second axially opposed surfaces, designated 46 and 48, respectively. This second flat strip-like portion 40 at the first edge 42 thereof being engageable with at least a portion of a bar-like member 50 disposed parallel to a longitudinal axis of such printing plate cylinder 14. Such bar-like member 50 being 12 of the printing plate cylinder 14 adjacent such working surface. Further, such second flat strip-like portion 40 has a second predetermined length and a second predetermined width and a second predetermined thickness. There is provided a first elongated connecting strip-like portion 52 having each of first and second axially opposed edges, designated 54 and 56, respectively, and first and second axially opposed surfaces, designated 58 and 60, respectively. The first edge 54 of such first connecting strip-like portion 52 is engaged with and secured to the first edge of such first flat strip-like portion 16 and the second edge 56 of such first connecting strip-like portion 52 is engaged with and secured to the second edge 44 of said second flat strip-like portion 40 thereby forming such first J-shaped hook-like member 30. The first connecting strip-like portion 52 has a third predetermined length and third predetermined width and third predetermined thickness.

The apparatus 10 further includes a second elongated J-shaped hook-like member, generally designated 60. Such second hook-like member 60 includes a third elongated substantially flat strip-like portion 58 having each of first and second axially opposed edges, designated 62 and 64, respectively, and first and second axially opposed surfaces, designated 66 and 68, respectively A first of such first and second axially opposed surfaces 66 and 68 of such third flat strip-like portion 58 is engageable with and securable to one of such one edge portion of such upper surface 32 of such carrier sheet 36 and a second of such first and second axially opposed surfaces 66 and 68 of such first flat strip-like portion 16. Such third flat strip-like portion 58 has a fourth predetermined length and a fourth predetermined width and a fourth predetermined thickness. The second hook-like member 70 further has a fourth elongated substantially flat strip-like portion 70 having each of first and second axially opposed edges designated 72 and 74, respectively, and first and second axially opposed surfaces, designated 76 and 78, respectively. Such fourth flat strip-like portion 70 having a fifth predetermined length and a fifth predetermined width and fifth predetermined thickness. A second elongated connecting strip-like portion 80 having each of first and second axially opposed edges designated 82 and 84, respectively, and first and second axially opposed surfaces, designated 86 and 88, respectively, completes the second hook-like member 60. The first edge 82 of said second connecting strip-like portion 80 is engaged with and secured to said first edge 62 of said third flat strip-like portion 58 and said second edge 84 of said second connecting strip-like portion 80 is engaged with and secured to said first edge 72 of such fourth flat strip-like member 70, thereby forming such second J-shaped hook-like member 60. Such second connecting strip-like portion 80 having a sixth predetermined length and a sixth predetermined width and a sixth predetermined thickness member.

The final essential component of this embodiment of the apparatus 10 is a third elongated J-shaped hook-like member, generally designated 90. Such third hook-like member 90 includes a fifth elongated substantially flat strip-like portion 92 having each of first and second axially opposed edges, designated 92 and 94, respectively, and first and second axially opposed surfaces, designated 96 and 98, respectively. One of such first and second axially opposed surfaces 96 and 98 is engageable with and securable to one edge portion of one of an upper surface 100 and a bottom surface 102 of a second carrier sheet 104 having at least one printing plate 104 disposed on such upper surface 100 thereof. Such fifth flat-strip-like portion 92 having a seventh predetermined length and a seventh predetermined width and a seventh predetermined thickness. Also included in the third hook-like member 90 is a sixth elongated substantially flat strip-like portion 106 having each of first and second axially opposed edges, designated 108 and 110, respectively, and first and second axially opposed surfaces, designated 112 and 114, respectively. The first edge 108 of such sixth flat strip-like portion 106 is positionable adjacent the first surface 86 of the second connecting strip-like portion 80 during use of said apparatus 10. Such sixth flat strip-like portion 106 having an eighth predetermined length and an eighth predetermined width and an eighth predetermined thickness. The final essential component of the third hook-like member 90 is a third connecting strip-like portion 116 having each of first and second axially opposed edges, designated 118 and 120, respectively, and first and second axially opposed surfaces, designated 122 and 126, respectively. The first edge 118 of such third connecting strip-like portion 116 is engaged with and secured to said first edge 92 of the fifth flat strip-like portion 92 and the second edge 120 of such third connecting strip-like portion 116 is engaged with and secured to said second edge 110 of such sixth flat strip-like portion 106. Such second edge 74 of the fourth flat strip-like portion 70 is positionable adjacent the first surface of 122 of such third connecting strip-like portion 116 during such use of said apparatus 10. Such third connecting strip-like portion 116 has a ninth predetermined length and a ninth predetermined width and a ninth predetermined thickness.

In the presently preferred embodiment of the invention, such one edge of such carrier sheet 36 is engageable with the first surface 26 of the first flat strip-like portion 16 and the one edge of such printing plate carrier 104 is engageable with the second surface 98 of such fifth flat strip-like portion 92.

It is also preferred that such apparatus 10 will further include a pair of securing means for securing such carrier sheet 36 to such first hook-like member 30 and such printing plate carrier sheet 104 to the third hook-like member 90. Such securing means can be either stitching or adhesive, although stitching is preferred.

Also, in the presently preferred embodiment, the predetermined width of such first flat strip-like portion 16 will be substantially equal to such predetermined width of such third flat strip-like portion 58.

It is even more preferred that the predetermined length of each of such first flat strip-like portion 16 and such second flat strip-like portion 40 and such third flat strip-like portion 58 and such fourth flat strip-like portion 70 is substantially identical.

Likewise, such predetermined thickness of each of the first flat strip-like portion 16 and such second flat strip-like portion 40 and such third flat strip-like portion 58 and the fourth flat strip-like portion 70 will be substantially identical in the preferred embodiment of the invention.

For the sake of economy, it is preferred that such first flat strip-like portion 16 and such second flat strip-like portion 40 and such first connecting strip-like portion 52 be formed integrally as a single piece.

It is further preferred that such third flat strip-like portion 58 and such fourth flat strip-like portion 70 and such second connecting strip-like portion 40 be formed integrally as a single piece.

Also, such fifth flat strip-like portion 92 and such sixth flat strip-like portion 106 and said third connecting strip-like portion 116 will be formed integrally as a single piece in the preferred embodiment of the invention.

Each of the above described single pieces can be manufactured as an extruded plastic part.

It is also preferred that each of said first flat strip-like portion 16 and the second flat strip-like portion 40 and such third flat strip-like portion 58 and such fourth flat strip-like portion 70 and such fifth flat strip-like portion 92 and such sixth flat strip-like portion 116 is substantially rectangular in shape.

Figure 3:
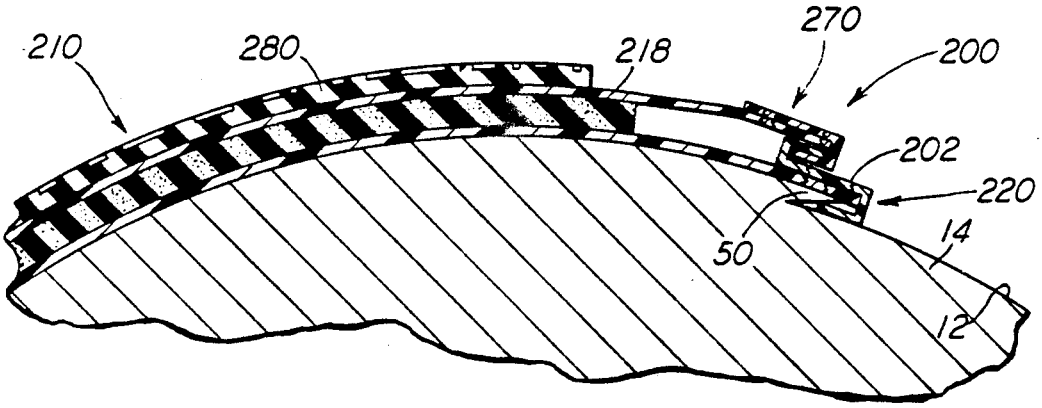
FIG. 3 is a fragmented side elevation view, in cross-section, which illustrates an alternative embodiment of the invention engaged on a working surface of a printing plate cylinder.
Figure 4:
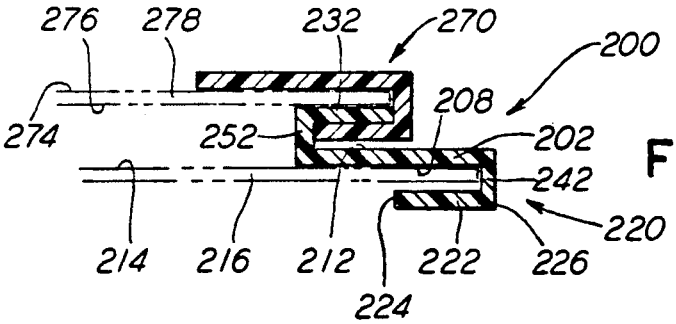
FIG. 4 an enlarged fragmented side elevation view, in cross-section, which illustrates the printing plate composite securing apparatus shown in FIG. 3.

Reference is now made to FIGS. 3 and 4 wherein there is illustrated an apparatus, generally designated 200, useful in forming a printing plate composite, generally designated 210, and which enables such printing plate composite formed therewith to be quickly secured both in place and in an accurately aligned position on at least a predetermined portion of a working surface 12 of a printing plate cylinder 14 positioned in at least one print station (not shown) disposed in a printing arrangement (not shown).

The apparatus 200 comprises an elongated substantially S-shaped double hook-like member, generally designated 220. Such double hook-like member includes a first elongated substantially flat strip-like portion 202 having each of first and second axially opposed edges designated 204 and 206, respectively, and first and second axially opposed surfaces, designated 208 and 212, respectively. The first surface 208 is being engageable with and securable to one edge portion of an upper surface 214 of a first carrier sheet 216 having a sponge-like member 218 disposed on such upper surface 214 thereof. This first flat strip-like portion 202 has a first predetermined length and a first predetermined width and first predetermined thickness. The double hook-like member 220 further has a second elongated substantially flat strip-like portion 222 having each of first and second axially opposed edges, designated 224 and 226, respectively, and first and second axially opposed surfaces, designated 228 and 230, respectively. The first edge 224 of such second flat strip-like portion 222 is engageable with at least a portion of a bar-like member 50 disposed parallel to a longitudinal axis of such printing plate cylinder 14 and adjacent such working surface 12 thereof. Such second flat strip-like portion 222 having a second predetermined length and a second predetermined width and a second predetermined thickness. Also part of the double hook-like member 220 is a third elongated substantially flat strip-like portion 232 having each of first and second axially opposed edges, designated 234 and 236, respectively, and first and second axially opposed surfaces, designated 238 and 240, respectively. Such third flat strip-like portion 232 has a third predetermined length and a third predetermined width and a third predetermined thickness. There is a first elongated connecting strip-like portion 242 having each of first and second axially opposed edges, designated 244 and 246, respectively, and first and second axially opposed surfaces, designated 248 and 250, respectively. The first edge 244 of such first connecting strip-like portion 242 is engaged with and secured to the first edge 204 of said first flat strip-like portion 202 and the second edge 246 of such first connecting strip-like portion 202 is engaged with and connected to such second edge 226 of the second flat strip-like portion 222. This first connecting strip-like portion 242 has a fourth predetermined length and a fourth predetermined width and a fourth predetermined thickness. There is also a second elongated connecting strip-like portion 252 having each of first and second axially opposed edges, designated 254 and 256, respectively, and first and second axially opposed surfaces, designated 258 and 260, respectively. Such first edge 254 of the second connecting strip-like portion 252 is engaged with and connected to the second edge 206 of such first flat strip-like portion 202 and the second edge 256 of said second connecting strip-like portion 252 is engaged with and connected to the first edge 234 of such third flat strip-like portion 232. This second connecting strip-like portion 252 has a fifth predetermined length and a fifth predetermined width and a fifth predetermined thickness.

The apparatus further includes an elongated substantially J-shaped hook-like member, generally designated 270. Such J-shaped hook-like member includes a fourth elongated substantially flat strip-like portion 262 having each of first and second axially opposed edges, designated 264 and 266, respectively, and first and second axially opposed surfaces, designated 268 and 272, respectively. One of such first and said second surfaces 268 and 272 is engageable with and securable to one edge portion of one of a respective upper surface 274 and a bottom surface 276 of a second carrier sheet 278 having at least one printing plate 280 mounted on such upper surface 274 of such second carrier sheet 278. Such fourth flat strip-like portion 262 having a sixth predetermined length and a sixth predetermined width and a sixth predetermined thickness. The J-shaped hook-like member 270 also includes a fifth elongated substantially flat strip-like portion 282 having each of first and second axially opposed edges, designated 284 and 286, respectively, and first and second axially opposed surfaces, designated 288 and 290, respectively. Such first edge 284 of this fifth flat strip-like portion 282 is positionable adjacent the first surface 258 of such second connecting strip-like portion 252 during use of the apparatus 200. This fifth flat strip-like portion 282 has a seventh predetermined length and a seventh predetermined width and a seventh predetermined thickness Finally, the J-shaped hook-like member 270 includes a third elongated connecting strip-like portion 292 having each of first and second axially opposed edges, designated 294 and 296, respectively, and first and second axially opposed surfaces, designated 297 and 298, respectively. The first edge 294 of such third connecting strip-like portion 292 is engaged with and secured to the first edge 264 of said fourth flat strip-like portion 262 and the second edge 296 of such third connecting strip-like portion 292 is engaged with and connected to the second edge 286 of such fifth flat strip-like portion 282. Such second edge 246 of such third flat strip-like portion 242 is positionable adjacent the first surface 297 of such third connecting strip-like portion 292 during such use of the apparatus 200. Such third connecting strip-like portion 292 has an eighth predetermined length and an eighth predetermined width and eighth predetermined thickness.

In this embodiment of the invention, it is preferred that such second flat strip-like portion 222 and such third flat strip-like portion 232 will have substantially identical width and thicknesses. It is also preferred that each of the first connecting strip-like portion 242 and such second connecting strip-like portion 252 have substantially identical width and thicknesses.

According to the preferred embodiment, the apparatus 200 will include a pair of securing means, such as stitching and adhesive, which will secure the carrier sheet 216 to the first flat strip-like portion 202 and the printing plate carrier sheet 278 to the J-shaped hook-like member 270. Stitching is the most preferred securing means.

Figure 5:
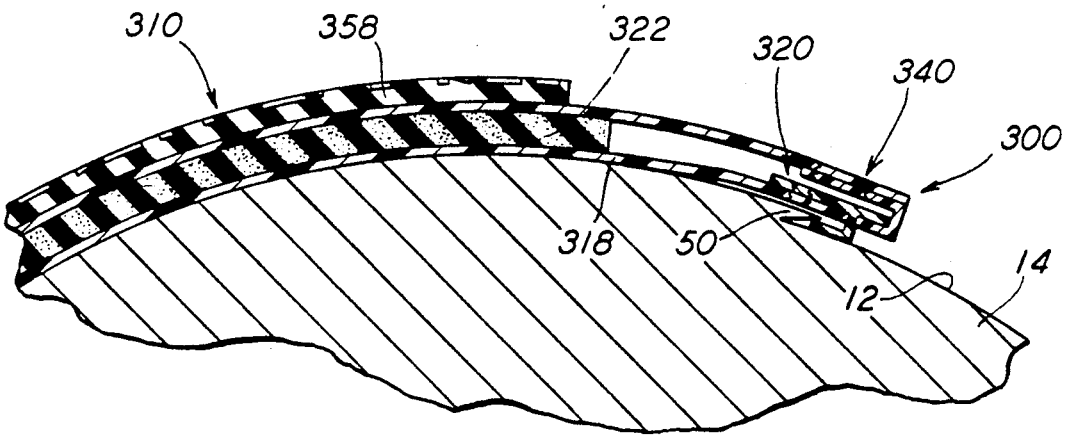
FIG. 5 is a fragmented side elevation view, in cross-section, which illustrates another alternative embodiment of alternative embodiment of the invention engaged on a working surface of a printing plate cylinder.
Figure 6:
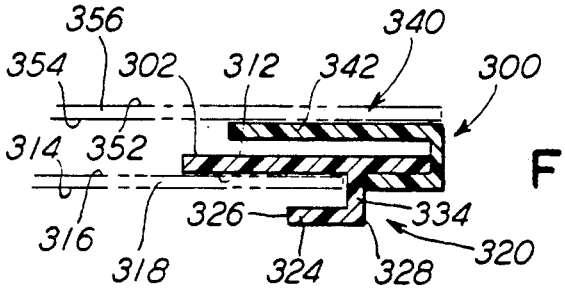
FIG. 6 is an enlarged fragmented side elevation view, in cross-section, which illustrates the printing plate composite securing apparatus shown in FIG. 5.

Reference is now made to FIGS. 5 and 6 wherein there is illustrated, another alternative apparatus, generally designated 300, useful in forming a printing plate composite, generally designated 310. The apparatus 300 enables such printing plate composite formed therewith to be quickly secured both in place and in an accurately aligned position on at least a predetermined portion of a working surface 12 of a printing plate cylinder 14 positioned in at least one print station (not shown) disposed in a printing arrangement (not shown).

Such apparatus 300 includes an elongated hook-like member, generally designated 320 Such hook-like member 320 includes a first elongated substantially flat strip-like portion 302 having each of first and second axially opposed edges, designated 304 and 306, respectively, and first and second axially opposed surfaces, designated 308 and 312, respectively. One of such first surface 308 and at least a first portion of such second surface 312 is engageable with and securable to one edge portion of a bottom surface 314 and an upper surface 316, respectively, of a first carrier sheet 318 having a sponge-like material 322 disposed on such upper surface 316 thereof. This first flat strip-like portion 302 has a first predetermined length and first predetermined width and a first predetermined thickness. Such hook-like member 320 further has a second elongated substantially flat strip-like portion 324 having each of first and second axially opposed edges, designated 326 and 328, respectively, and first and second axially opposed surfaces, designated 330 and 332 respectively. The first edge 326 of such second flat strip-like portion 324 is engageable with a bar-like member 50 disposed substantially parallel to a longitudinal axis of such printing plate cylinder 14 and adjacent such working surface 12 thereof. Such second flat strip-like portion 324 having a second predetermined length and a second predetermined width and a second predetermined thickness. Finally, the hook-like member 320 includes a first connecting strip-like portion 334 having each of first and second axially opposed edges, designated 336 and 338, respectively, and first and second axially opposed surfaces, designated 340 and 342, respectively. The first edge 336 of such first connecting strip-like portion 334 is engaged with and connected to the second surface 312 of the first flat strip-like portion 302 intermediate such first and second axially opposed edges, 304 and 306 thereof. The second edge 338 of such first connecting strip-like portion 334 is engageable with and connected to the second edge 328 of such second flat strip-like portion 324. Such first connecting strip-like portion 334 has a third predetermined length and a third predetermined width and a third predetermined thickness.

The final essential component of such apparatus 300 is an elongated substantially J-shaped hook-like member, generally designated 340. Such J-shaped hook-like member includes a third elongated substantially flat strip-like portion 342 having each of first and second axially opposed edges, designated as 344 and 346, respectively, and first and second axially opposed surfaces, designated as 348 and 350, respectively. One of such first and such second axially opposed surfaces 348 and 350 is engageable with and securable to one edge portion of one of an upper surface 352 and a bottom surface 354, respectively, of a second carrier sheet 356 having at least one printing plate 358 mounted thereon. Such third flat strip-like portion 342 has a fourth predetermined length and a fourth predetermined width and a fourth predetermined thickness. Such J-shaped hook-like member 340 also includes a fourth elongated substantially flat strip-like portion 360 having each of first and second axially opposed edges, designated as 362 and 364, respectively, and first and second axially opposed surfaces, designated as 366 and 368, respectively. The first edge 362 of such fourth flat strip-like portion 360 is positionable adjacent such second surface 342 of the first connecting strip-like portion 334 during use of said apparatus 300. This fourth flat strip-like portion 360 has a fifth predetermined length and fifth predetermined width and a fifth predetermined thickness. Such J-shaped hook-like member 340 also requires a second elongated connecting strip-like portion 370 having each of first and second axially opposed edges, designated 372 and 374, respectively, and first and second axially opposed surfaces, designated 376 and 380, respectively The first edge 372 of such second connecting strip-like portion 370 is engaged with and connected to the first edge 344 of the third flat strip-like portion 342 and the second edge 374 of such second connecting strip-like portion 370 is engaged with and connected to the second edge of such fourth flat strip-like portion 360. The first edge 304 of such first flat strip-like portion 302 is adjacent the first surface 376 of such second connecting strip-like portion 370 during such use of such apparatus 300. Such second connecting strip-like portion 370 has a sixth predetermined length and a sixth predetermined width and a sixth predetermined thickness.

In the presently preferred embodiment of the invention shown in FIGS. 5 and 6, the apparatus 300 will further include a securing means which is engageable with each of the carrier sheet 3118 and the first flat strip-like portion 302 for securing such carrier sheet 318 to such first flat strip-like portion 302. Such securing means can be either stitching, which is preferred, or an adhesive.

Also a securing means, such as stitching or adhesive, is provided for securing such printing plate carrier sheet 356 to such J-shaped hook-like member 340.

Further, such first flat strip-like portion 302 and such second flat strip-like portion 324 and the first connecting strip-like portion 334 will be formed integrally as a single piece. This can best be accomplished by extruding plastic into the required shape. It is also preferred for the third flat strip-like portion 342 and the fourth flat strip-like portion 360 and the second connection strip-like portion 370 to be formed in the same manner.

Finally, in this embodiment, it is preferred for each of such first flat strip-like portion 302 and such second flat strip-like portion 324 and the third flat strip-like portion 360 to be substantially rectangular in shape.

Figure 7:
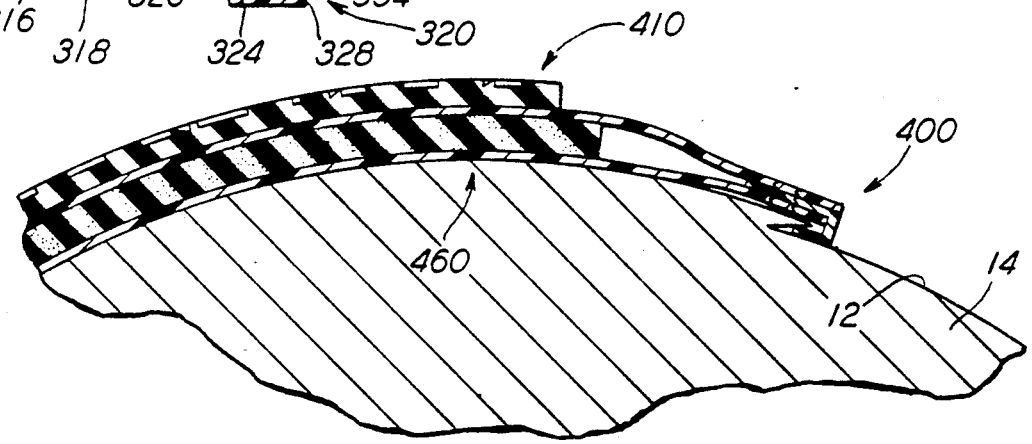
FIG. 7 is a fragmented side elevation view, in cross-section, which illustrates a presently preferred printing plate composite.
Figure 8:
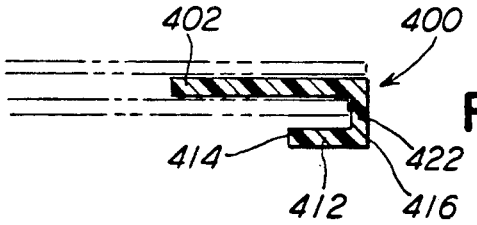
FIG. 8 is an enlarged view of the securing apparatus used in the printing plate composite illustrated in FIG. 7.

Now reference is made to FIGS. 7 and 8, wherein one presently preferred embodiment of an improved compressible-type printing plate composite, generally designated 410, constructed according to the present invention is illustrated. This printing plate composite 410 includes both a quick mounting and a quick alignment system, generally designated 400, incorporated therein. Such mounting and alignment system 400 enables the printing plate composite 410 to be relatively quickly secured in place, in an accurately aligned predetermined position on at least a predetermined portion of a working surface 12 of a printing plate cylinder 114 positioned in at least one print station (not shown) disposed in a printing arrangement (not shown).

The printing plate composite 4110 includes an elongated substantially J-shaped hook-like member, generally designated 400. Such substantially J-shaped hook-like member 400 serves as the quick mounting and quick alignment system in the present invention. The substantially J-shaped member 400 includes a first elongated flat strip-like portion 402. In the presently preferred embodiment of this invention, such first flat strip-like portion 402 will be substantially rectangular in shape. In any event, the first flat strip-like portion 402 has axially opposed first and second edges, designated respectively as 404 and 406, and axially opposed first and second surfaces, designated respectively as 408 and 410, and axially opposed first and second ends (not shown). In addition, this first flat strip-like portion 402 has each of a first predetermined length and a first predetermined width and a first predetermined thickness.

This substantially J-shaped hook-like member 400 also includes a second elongated flat strip-like portion 412. Like the first flat strip-like portion 402, such second flat strip-like portion 412 will be substantially rectangular in shape, in the presently preferred embodiment of the invention. The second flat strip-like portion 412 includes axially opposed first and second edges, designated respectively as 414 and 416, and axially opposed first and second surfaces, designated respectively as 418 and 420, and axially opposed first and second ends (not shown). Also, the second flat strip-like portion 412 has a second predetermined length and a second predetermined thickness and a second predetermined width. In the presently preferred embodiment of the invention, the second predetermined length and the second predetermined thickness of such second flat strip-like portion 412 will be substantially the same as the first predetermined length and the first predetermined thickness of such first flat strip-like portion 402. On the other hand, the second predetermined width of the second flat strip-like portion 412 will be substantially narrower than the first predetermined width of such first flat strip-like portion 402. For example, the second flat strip-like portion 412 will have a width equal to between about 0.25 and 0.4 times the width of such first flat strip-like portion 402. The first edge 414 of such second flat strip-like portion is engageable with the bar-like member 50 disposed substantially parallel to the longitudinal axis of such printing plate cylinder 14 and adjacent such working surface 12 thereof.

The substantially J-shaped hook-like member 400 further includes an elongated connecting strip-like portion 422. In the presently preferred embodiment of the invention, this connecting strip-like portion 422 is preferably also generally rectangular in shape. The connecting strip-like portion 422 has axially opposed first and second edges, designated respectively as 424 and 426, and axially opposed first and second surfaces, designated respectively as 428 and 430, and axially opposed first and second ends (not shown). Additionally, the connecting strip-like portion 422 has a third predetermined length and a third predetermined width and a third predetermined thickness. Preferably, the third predetermined length of such connecting strip-like portion 422 will be substantially identical to the second predetermined length of such second flat strip-like portion 412, and the third predetermined width of such connecting strip-like portion 422 will be between 0.2 and 0.33 times the first predetermined width of such first flat strip-like portion 402, and the third predetermined thickness of such connecting strip-like portion 422 will be equal to or slightly less than the first predetermined thickness of such first flat strip-like portion 402. This connecting strip-like portion 422 is connected, substantially along the entire length of such first edge 424 thereof, to such first edge 414 of such second flat strip-like portion 412. The second edge 426 of such connecting strip-like portion 422 is connected to the second edge 406 of the first flat strip-like portion 402.

Such printing plate composite 410 further includes a carrier sheet, generally designated 460, which has a predetermined length and a predetermined width and a predetermined thickness. The predetermined length of such carrier sheet 460 is determined by a number of factors. These factors include, for example, the diameter of such printing plate cylinder 14 and the size of the printing plate required for a particular job. The predetermined width of such carrier sheet 460 will, in the presently preferred embodiment of the invention, be substantially the same as the predetermined length of the first flat strip-like portion 402. The predetermined thickness of the carrier sheet 460, as will become clear, hereinafter, can vary within a rather narrow range. At least a portion of an outer surface 462 of such carrier sheet 460 is engageable with the working surface 12 of such printing plate cylinder 14. Such carrier sheet 460, in the presently preferred embodiment of the invention, will be made from a polyester material. Such material is presently available as mylar.

The printing plate composite 410 further includes a sponge-like member, generally designated 470. Such sponge-like member 470 has a predetermined length (to be discussed hereinafter) and a predetermined width, which preferably will be substantially identical to the predetermined width of the carrier sheet 460 and a predetermined thickness which will also be discussed hereinafter. A first surface 464 of the sponge-like member 470 is engageable with and secured to an axially opposed inner surface 466 of the carrier sheet 460. Preferably, this sponge-like member 470 will be a cellular polyurethane material.

Such cellular polyurethane material will have a predetermined density within a range of between about 10.0 and 40.0 pounds per cubic foot. Preferably, such density will be between about 20.0 and 30.0 pounds per cubic foot.

In order to provide a printing plate composite 410 having a thickness of between about 0.260 inches and about 0.280 inches, the predetermined thickness of the carrier sheet 460 plus the predetermined thickness of the sponge-like member 470 will be in a range of between about 0.120 and 0.10 inches in the presently preferred embodiment of the invention.

Another essential component of the printing plate composite 410 is a printing plate carrier sheet, generally designated 480, having a predetermined length and a predetermined width and a predetermined thickness. Preferably, the predetermined length of such printing plate carrier sheet 480 will at least be equal to or slightly greater than the predetermined length of such carrier sheet 460. Additionally, the predetermined width of such printing plate carrier sheet 480 will be substantially the same as the predetermined width of such carrier sheet 460. The predetermined thickness of such printing plate carrier sheet 480 will be generally about 0.030 inches. In the presently preferred embodiment of the invention, such printing plate carrier sheet 480 will be made from a vinyl material. A first surface 468 of such printing plate carrier sheet 480 is slidably engageable with an axially opposed second surface 472 of the sponge-like member 470. The axially opposed second surface 474 of such printing plate carrier sheet 480 is capable of having at least one printing plate 476 adhered thereto. One of the carrier sheet 460 and the printing plate carrier sheet 480 being engageable with one of such first surface 408 and such second surface 410 of such first flat strip-like portion 402 adjacent a respective outer edge 478 and 482 thereof. An opposite one of such carrier sheet 460 and such printing plate carrier sheet 480 is engageable adjacent such respective outer edge 478 and 482 with one of the first surface 408 and the second surface 410 of the first flat strip-like portion 402 and such respective outer edge 478 and 482 of such carrier sheet 460 and such printing plate carrier sheet 480. In this embodiment of the invention, such predetermined length of such carrier sheet 460 is greater than the predetermined length of such sponge-like member 470 by a length that is at least equal to a width of such outer edge 478 of the carrier sheet 460. Also, in the presently preferred embodiment of this invention, each of such carrier sheet 460 and the sponge-like member 470 and the printing plate carrier sheet 480 will be substantially rectangular in shape.

A securing means, generally designated 490, engageable with each of the first flat strip-like portion 402 and such outer edge 478 of the carrier sheet 460 and such one edge 482 of the printing plate carrier sheet 480 is provided to secure the carrier sheet 460 and the printing plate carrier sheet 480 to such first flat strip-like portion 402 and thereby form such improved compressible-type printing plate composite 410. Such securing means 490 can be either stitching 484 (FIG. 7) or an adhesive 486 (FIG. 8). In the most preferred embodiment of the present invention, the outer edge 478 of the carrier sheet 460 is engageable with the first surface 408 of such first flat strip-like portion 402 and the outer edge 482 of such printing plate carrier sheet 480 is engageable with such surface 410 of the first flat strip-like portion 402 and stitched in place.

The printing plate 476 can be made from rubber or photopolymer, but will preferably be a photopolymer material.

It is presently preferred that such substantially J-shaped hook-like member 410 be formed integrally as a single piece. This, for example, can be accomplished by extruding plastic into such substantially J-shaped hook-like member 410.

If, for example, the carrier sheet 460 is to be held in place on such working surface 12 of the printing plate cylinder 14 by a vacuum, then such carrier sheet 460 must be impervious to the passage of air therethrough.

While a number of presently preferred and alternative embodiments of the improved compressible-type printing plate composite constructed according to the present invention have been described in detail above, various other modifications and adaptations of such invention can be made by persons skilled in the printing art without departing from the spirit and scope of the appended claims.

I claim:

1. A printing plate composite securing apparatus which enables such printing plate composite formed therewith to be quickly secured both in place and in an accurately aligned position on at least a predetermined portion of a working surface of a printing plate cylinder having a bar-like member and positioned in at least one point station disposed in a printing arrangement, said apparatus comprising:

(a) a first elongated J-shaped hook-like member, said first hook-like member including, (i) a first elongated substantially flat strip-like portion having each of first and second axially opposed edges and first and second axially opposed surfaces, one of said first and second axially opposed surfaces being engageable with and securable to one edge portion of one of an upper surface and a bottom surface of a first carrier sheet having a sponge-like member disposed on such upper surface thereof, said first flat strip-like portion having a first predetermined length and first predetermined width and first predetermined thickness, (ii) a second elongated substantially flat strip-like portion having each of first and second axially opposed edges and first and second axially opposed surfaces, said second flat strip-like portion at said first edge thereof being engageable with at least a portion of such bar-like member disposed parallel to a longitudinal axis of such printing plate cylinder and adjacent such working surface, said second flat strip-like portion having a second predetermined length and a second predetermined width and a second predetermined thickness, and (iii) a first elongated connecting strip-like portion having each of first and second axially opposed edges and first and second axially opposed surfaces, said first edge of said first connecting strip-like portion is engaged with and secured to said first edge of said first flat strip-like portion and said second edge of said first connecting strip-like portion is engaged with and secured to said second edge of said second flat strip-like portion thereby forming said first J-shaped hook-like member, said first connecting strip-like portion having a third predetermined length and third predetermined width and third predetermined thickness, (b) a second elongated J-shaped hook-like member, said second hook-like member including, (i) a third elongated substantially flat strip-like portion having each of first and second axially opposed edge and first and second axially opposed surfaces, a first of said first and second axially opposed surfaces of said third flat strip-like portion being engageable with and securable to one of said one edge portion of said upper surface of said carrier sheet and a second of said first and second axially opposed surfaces of said first flat stripe like portion, said third flat strip-like portion having a fourth predetermined length and a fourth predetermined width and a fourth predetermined thickness, (ii) a fourth elongated substantially flat strip-like portion having each of first and second axially opposed edges and first and second axially opposed surfaces, said fourth flat strip-like portion having a fifth predetermined length and a fifth predetermined width and fifth predetermined thickness, and (iii) a second elongated connecting strip-like portion having each of first and second axially opposed edges and first and second axially opposed surfaces, said first edge of said second connecting strip-like portion is engaged with and secured to said first edge of said third flat strip-like portion and said second edge of said second connecting strip-like portion is engaged with and secured to said first edge of said fourth flat strip-like portion, thereby forming said second J-shaped hook-like member, said second connecting strip-like portion having a sixth predetermined length and a sixth predetermined width and a sixth predetermined thickness member; and (c) a third elongated J-shaped hook-like member, said third hook-like member including, (i) a fifth elongated substantially flat strip-like portion having each of first and second axially opposed edges and first and second axially opposed surfaces, one of said first and second axially opposed surfaces being engageable with and securable to one edge portion of one of an upper surface and a bottom surface of a second carrier sheet having at least one printing plate disposed on such upper surface thereof, said fifth flat-strip-like portion having a seventh predetermined length and a seventh predetermined width and a seventh predetermined thickness, (ii) a sixth elongated substantially flat strip like portion having each of first and second axially opposed edges and first and second axially opposed surfaces, said first edge of said sixth flat strip-like portion being positionable adjacent said first surface of said second connecting strip-like portion during use of said apparatus, said sixth flat strip-like portion having an eighth predetermined length and an eighth predetermined width and an eighth predetermined thickness, and (iii) a third connecting strip-like portion having each of first and second axially opposed edges and first and second axially opposed surfaces, said first edge of said third connecting strip-like portion is engaged with and secured to said first edge of said fifth flat strip-like portion and said second edge of said third connecting strip like portion is engaged with and secured to said second edge of said sixth flat strip like portion, said second edge of said fourth flat strip-like portion being positionable adjacent said first surface of said third connecting strip-like portion during such use of said apparatus, said third connecting strip-like portion having a ninth predetermined length and a ninth predetermined width and a ninth predetermined thickness.

2. A printing plate composite securing apparatus, according to claim 1, wherein such one edge portion of such first carrier sheet is engageable with said first surface of said first flat strip-like portion and said one edge of said second carrier sheet is engageable with said second surface of said fifth flat strip-like portion.

3. A printing plate composite securing apparatus, according to claim 1, wherein said apparatus further includes a pair of securing means for securing such first carrier sheet to said first hook-like member and such second carrier sheet to said third hook-like member.

4. A printing plate composite securing apparatus, according to claim 3, wherein said pair of securing means are one of stitching and adhesive.

5. A printing plate composite securing apparatus, according to claim 4, wherein said pair of securing means are stitching.

6. A printing plate composite securing apparatus, according to claim 2, wherein such one edge portion of such first carrier sheet and such one edge portion of such second carrier sheet are secured, respectively, to said first surface of said first flat strip-like portion and said second surface of said fifth flat strip-like portion by stitching.

7. A printing plate composite securing apparatus, according to claim 1, wherein said predetermined width of said first flat strip-like portion is substantially equal to said predetermined width of said third flat strip-like portion.

8. A printing plate composite securing apparatus, according to claim 7, wherein said predetermined length of each of said first flat strip-like portion and said second flat strip-like portion and said third flat strip-like portion and said fourth flat strip-like portion is substantially identical.

9. A printing plate composite securing apparatus, according to claim 8, wherein said predetermined thickness of each of said first flat strip-like portion and said second flat strip-like portion and said third flat strip-like portion and said fourth flat strip-like portion is substantially identical.

10. A printing plate composite securing apparatus, according to claim 9, wherein said first flat strip-like portion and said second flat strip-like portion and said first connecting strip-like portion are formed integrally as a single piece.

11. A printing plate composite securing apparatus, according to claim 10, wherein said third flat strip-like portion and said fourth flat strip-like portion and said second connecting strip-like portion are formed integrally as a single piece.

12. A printing plate composite securing apparatus, according to claim 1 wherein said fifth flat strip-like portion and said fourth flat strip-like portion and said second connecting strip-like portion are formed integrally as a single piece.

13. A printing plate composite securing apparatus, according to claim 12, wherein each of said single pieces is extruded plastic.

14. A printing plate composite securing apparatus, according to claim 1, wherein each of said first flat strip-like portion and second flat strip-like portion and said third flat strip-like portion and said fourth flat strip-like portion and said fifth flat strip-like portion and said sixth flat strip-like portion is substantially rectangular in shape.

15. A printing plate composite securing apparatus which enables such printing plate composite formed therewith to be quickly secured both in place and in an accurately aligned position or at least a predetermined portion of a working surface of a printing plate cylinder having a bar-like member and positioned in at least one print station disposed in a printing arrangement, said apparatus comprising;

(a) an elongated substantially S-shaped double hook-like member, said double hook-like member including, (i) a first elongated substantially flat strip-like portion having each of first and second axially opposed edges and first and second axially opposed surfaces, said first surface being engageable with and securable to one edge portion of an upper surface of a first carrier sheet having a sponge-like member disposed on such upper surface thereof, said first flat strip-like portion having a first predetermined length and a first predetermined width and first predetermined thickness, (ii) a second elongated substantially flat strip-like portion having each of first and second axially opposed edges and first and second axially opposed surfaces, said first edge of said second flat strip-like portion being engageable with at least a portion of such bar-like member disposed parallel to a longitudinal axis of such printing plate cylinder and adjacent such working surface thereof, said second flat strip-like portion having a second predetermined length and a second predetermined width and a second predetermined thickness, (iii) a third elongated substantially flat strip-like portion having each of first and second axially opposed edges and first and second axially opposed surfaces, said third flat strip-like portion having a third predetermined length and a third predetermined width and a third predetermined thickness, (iv) a first elongated connecting strip-like portion having each of first and second axially opposed edges and first and second axially opposed surfaces, said first edge of said first connecting strip-like portion is engaged with and secured to said first edge of said first flat strip-like portion and said second edge of said first connecting strip-like portion is engaged with and connected to said second edge of said second flat strip-like portion, said first connecting strip-like portion having a fourth predetermined length and a fourth predetermined width and a fourth predetermined thickness, (v) a second elongated connecting strip-like portion having each of first and second axially opposed edges and first and second axially opposed surfaces, said first edge of said second connecting strip-like portion is engaged with and connected to said second edge of said first flat strip-like portion and said second edge of said second connecting strip-like portion is engaged with and connected to said first edge of said third flat strip-like portion, said second connecting strip-like portion having a fifth predetermined length and a fifth predetermined width and a fifth predetermined thickness; and (b) an elongated substantially J-shaped hook-like member, said J-shaped hook-like member including, (i) a fourth elongated substantially flat strip-like portion having each of first and second axially opposed edges and first and second axially opposed surfaces, one of said first and said second surfaces being engageable with and securable to one edge portion of one of a respective upper surface and a bottom surface of a second carrier sheet having at least one printing plate mounted on such upper surface of such second carrier sheet, said fourth flat strip-like portion having a sixth predetermined length and a sixth predetermined width and a sixth predetermined thickness, (ii) a fifth elongated substantially flat strip like portion having each of first and second axially opposed edges and first and second axially opposed surfaces, said first edge of said fifth flat strip-like portion being positionable adjacent said first surface of said second connecting strip-like portion during use of said apparatus, said fifth flat strip-like portion having a seventh predetermined length and a seventh predetermined width and a seventh predetermined thickness, and (iii) a third elongated connecting strip-like portion having each of first and second axially opposed edges and first and second axially opposed surfaces, said first edge of said third connecting strip-like portion is engaged with and secured to said first edge of said fourth flat strip-like portion and said second edge of said third connecting strip-like portion is engaged with and connected to said second edge of said fifth flat strip-like portion, said second edge of said third flat strip-like portion being positionable adjacent said first surface of said third connecting strip-like portion during such use of said apparatus, said third connecting strip-like portion having an eighth predetermined length and an eighth predetermined width and eighth predetermined thickness.

16. A printing plate composite securing apparatus, according to claim 151, wherein said second flat strip-like portion and said third flat strip-like portion have substantially identical widths and thicknesses.

17. A printing plate composite securing apparatus, according to claim 161, wherein said first connecting strip-like portion and said second connecting strip-like portion have substantially identical widths and thicknesses.

18. A printing plate composite securing apparatus, according to claim 15, wherein said apparatus further includes a pair of securing means, a first of said securing means engageable with said first flat strip-like portion of said double hook-like member and such first carrier sheet for securing such first carrier sheet thereto and a second of said pair of securing means engageable with said fourth flat strip-like portion and such second carrier sheet for securing such second plate carrier sheet to said J-shaped hook-like member.

19. A printing plate composite securing apparatus, according to claim 18, wherein said securing means are one of stitches and adhesive.

20. A printing plate composite securing apparatus, according to claim 19, wherein said securing means are stitching.

21. A printing plate composite securing apparatus which enables such printing plate composite formed therewith to be quickly secured both in place and in an accurately aligned position on at least a predetermined portion of a working surface of a printing plate cylinder having a bar-like member and positioned in at least one print station disposed in a printing arrangement, said apparatus comprising:

(a) an elongated hook-like member, said hook-like member including, (i) a first elongated substantially flat strip-like portion having each of first and second axially opposed edges and first and second axially opposed surfaces, one of said first and at least a first portion of said second surfaces being engageable with and securable to one edge portion of a bottom surface and an upper surface, respectively, of a first carrier sheet having a sponge-like material disposed on such upper surface thereof, said first flat strip-like portion having a first predetermined length and first predetermined width and a first predetermined thickness, (ii) a second elongated substantially flat strip-like portion having each of first and second axially opposed edges and first and second axially opposed surfaces, said first edge of said second flat strip-like portion being engageable with such bar-like member disposed substantially parallel to a longitudinal axis of such printing plate cylinder and adjacent such working surface thereof, said second flat strip-like portion having a second predetermined length and a second predetermined width and a second predetermined thickness, and (iii) a first connecting strip-like portion having each of first and second axially opposed edges and first and second axially opposed surfaces, said first edge of said first connecting strip-like portion is engaged with and connected to said second surface of said first flat strip-like portion intermediate said first and second axially opposed edges, said second edge of said first connecting strip-like portion is engageable with and connected to said second edge of said second flat strip-like portion, said first connecting strip-like portion having a third predetermined length and a third predetermined width and a third predetermined thickness, and (b) an elongated substantially J-shaped hook-like member, said J-shaped hook-like member including, (i) a third elongated substantially flat strip-like portion having each of first and second axially opposed edges and first and second axially opposed surfaces, one of said first and said second axially opposed surfaces being engageable with and securable to one edge portion of one of an upper surface and a bottom surface, respectively, of a second carrier sheet having at least one printing plate mounted thereon, said third flat strip-like portion having a fourth predetermined length and a fourth predetermined width and a fourth predetermined thickness, (ii) a fourth elongated substantially flat strip-like portion having each of first and second axially opposed edges and first and second axially opposed surfaces, said first edge of said fourth flat strip-like portion being positionable adjacent said second surface of said first connecting strip-like portion during use of said apparatus, said fourth flat strip-like portion having a fifth predetermined length and fifth predetermined width and a fifth predetermined thickness, and (iii) a second elongated connecting strip-like portion having each of first and second axially opposed edges and first and second axially opposed surfaces, said first edge of said second connecting strip-like portion is engaged with and connected to said first edge of said third flat strip-like portion and said second edge of said second connecting strip-like portion is engaged with and connected to said second edge of said fourth flat strip-like portion, said first edge of said first flat strip-like portion being adjacent said first surface of said second connecting strip-like portion during such use of said apparatus, said second connecting strip-like portion having a sixth predetermined length and a sixth predetermined width and a sixth predetermined thickness.

22. A printing plate composite securing apparatus, according to claim 21, wherein said apparatus further includes securing means engageable with such first carrier sheet and said first flat strip-like portion for securing such first carrier sheet to said flat strip-like portion.

23. A printing plate composite securing apparatus, according to claim 21, wherein said apparatus further includes a securing means engaged with such second carrier sheet and said third flat strip-like portion for securing such second carrier sheet to said third flat strip-like portion.

24. A printing plate composite securing apparatus, according to claim 23, wherein said securing means is one of stitching and an adhesive.

25. A printing plate composite securing apparatus, according to claim 21, wherein said first flat strip-like portion and said second strip-like portion and said first connecting strip-like portion are formed integrally as a single piece.

26. A printing plate composite securing apparatus, according to claim 21, wherein said third flat strip-like portion and said fourth flat strip-like portion and said second connection strip-like portion are formed integrally as a single piece.

27. A printing plate composite securing apparatus, according to claim 21, wherein each of said first flat strip-like portion and said second flat strip-like portion and said third flat strip-like portion and said fourth flat strip-like portion is substantially rectangular in shape.

28. An improved compressible-type printing plate composite which includes both a quick mounting and a quick alignment system incorporated therein that will enable said printing plate composite to be quickly secured in place on at least a predetermined portion of a working surface of a printing plate cylinder having a bar-like member and positioned in at least one print station disposed in a printing arrangement, in an accurately aligned position, said compressible-type printing plate composite comprising:

(a) an elongated substantially J-shaped hook-like member, said hook-like member including, (i) a first elongated substantially flat strip-like portion having each of first and second axially opposed edges and first and second axially opposed surfaces, said first flat strip-like portion having a first predetermined length and a first predetermined width and a first predetermined thickness, (ii) second elongated substantially flat strip-like portion having each of first and second axially opposed edges and first and second axially opposed surfaces, said first edge of said second flat strip-like portion being engageable with said bar-like member disposed substantially parallel to a longitudinal axis of such print plate cylinder and adjacent such working surface thereof, said second flat strip-like portion having a second predetermined length and a second predetermined width and a second predetermined thickness, and (iii) an elongated connecting strip-like portion having each of first and second edges and first and second surfaces, said first edge of said connecting strip-like portion is engaged with and secured to said first edge of said first flat strip-like portion and said second edge of said connecting strip like portion is connected to said second edge of said second flat strip-like portion thereby forming said J-shaped hook-like member, said connecting strip-like portion having a third predetermined length and a third predetermined width and a third predetermined thickness;

(b) a first carrier sheet member having a fourth predetermined length and a fourth predetermined width and a fourth predetermined thickness, said first carrier sheet is engageable adjacent one edge of one of an upper surface and a bottom surface, respectively with one of said first and said second surfaces of said first flat strip-like portion;

(c) a sponge-like member secured to said upper surface of said first carrier sheet, said sponge-like member having a fifth predetermined length and a fifth predetermined width and a fifth predetermined thickness;

(d) a second carrier sheet having a sixth predetermined length and a sixth predetermined width and a sixth predetermined thickness, said second carrier sheet is engageable adjacent one edge of a bottom surface thereof with one of said one edge of said upper surface of said first carrier sheet and said second surface of said first flat strip-like portion;

(e) at least one printing plate member secured to an upper surface of said second carrier sheet; and (f) securing means engageable with each of said one edge of said first carrier sheet and said one edge of said second carrier sheet and said first flat strip-like portion for securing said first and said second carrier sheet to said first flat strip-like portion.

29. An improved compressible-type printing plate composite, according to claim 28, wherein said sponge-like member is a cellular polyurethane material having a predetermined density.

30. An improved compressible-type printing plate composite, according to claim 29, wherein said first carrier sheet is a polyester material.

31. An improved compressible-type printing plate composite, according to claim 30, wherein said predetermined length of said first carrier sheet is greater than said predetermined length of said sponge-like member by a length at least equal to a width of said one edge of said first carrier sheet.

32. An improved compressible-type printing plate composite, according to claim 31, wherein said predetermined width of said first carrier sheet is substantially equal to said predetermined width of said cellular polyurethane material.

33. An improved compressible-type printing plate composite, according to claim 32, wherein said predetermined thickness of said first carrier sheet plus said predetermined thickness of said cellular polyurethane material is in a range of between about 0.120 and about 0.10 inches.

34. An improved compressible-type printing plate composite, according to claim 33, wherein said predetermined thickness of said second carrier sheet is about 0.030 inches.

35. An improved compressible-type printing plate composite, according to claim 34, wherein said one edge of said first carrier sheet is engageable with said first surface of said first flat strip-like portion and said one edge of said second carrier sheet is engageable with said second surface of said first flat strip-like portion.

36. An improved compressible-type printing plate composite, according to claim 35, wherein said second carrier sheet is vinyl.

37. An improved compressible-type printing plate composite, according to claim 36, wherein said improved printing plate composite further includes a plurality of printing plates secured to said upper surface of said second carrier sheet.

38. An improved compressible-type printing plate composite, according to claim 37, wherein said printing plate is on of rubber and photopolymer.

39. An improved compressible-type printing plate composite, according to claim 38, wherein said printing plate is photopolymer.

40. An improved compressible-type printing plate composite, according to claim 38, wherein said printing plate composite has a thickness of between about 0.260 and about 0.280 inches.

41. An improved compressible-type printing plate composite, according to claim 28, wherein said first carrier sheet is held in place on such working surface of such printing plate cylinder by a vacuum and said first carrier sheet is impervious to passage of air therethrough.

* * * * *

UNITED STATES PATENT AND TRADEMARK OFFICE

CERTIFICATE OF CORRECTION

PATENT NO. : 5,103,729

DATED : April 14, 1992

INVENTOR(S) : Ivan N. Philpot

It is certified that error appears in the above-identified patent and that said Letters Patent is hereby corrected as shown below:

Column 2, line 8, after cylinder, insert --.--;

Column 2, line 31, after ensured, insert --.--;

Column 2, line 54, after members, insert --.--.

Column 3, line 22, delete "," and insert --'--.

Column 4, line 39, after surfaces, insert --.--.

Column 10, line 28, delete "alternative embodiment of".

Column 11, line 3, after 38, insert --.--;

Column 11, line 25, after edge, insert -- 18--;

Column 11, line 39, after respectively, insert --.--.

UNITED STATES PATENT AND TRADEMARK OFFICE

CERTIFICATE OF CORRECTION

PATENT NO. : 5,103,729

DATED : April 14, 1992

INVENTOR(S) : Ivan N. Philpot

It is certified that error appears in the above-identified patent and that said Letters Patent is hereby corrected as shown below:

Column 14, line 57, after ness, insert --.--.

Column 15, line 32, after 320, insert --.--.

Column 16, line 37, after respectively, insert --.--;

Column 16, line 53, delete "3118" and insert --318--.

Column 17, line 16, delete "114" and insert --14--;

Column 17, line 19, delete "4110" and insert --410--.

Column 20, line 9, before art, insert --plate--.

Column 21, line 3, delete "stripe" and insert --strip--;

Column 21, line 3, before like, insert -----;

Column 21, line 43, after strip, insert -----;

Column 21, line 59, after strip, insert -----;

Column 21, line 61, after strip, insert -----.

Column 22, line 53, delete "1", and insert --11,--.

Column 24, line 14, after strip, insert -----;

Column 24, line 41, delete "151" and insert --15--;

Column 24, line 45, delete "161" and insert --16--.

Column 26, line 67, before second, insert --a--.

UNITED STATES PATENT AND TRADEMARK OFFICE

CERTIFICATE OF CORRECTION

PATENT NO. : 5,103,729

DATED : April 14, 1992

INVENTOR(S) : Ivan N. Philpot

It is certified that error appears in the above-indentified patent and that said Letters Patent is hereby corrected as shown below:

Column 27, line 3, delete "said" and insert --such--.

Signed and Sealed this

Ninth Day of November, 1993

Bruce Lehman

*Attest:*

BRUCE LEHMAN

*Attesting Officer*

*Commissioner of Patents and Trademarks*